United States Patent [19]

Keller

[11] 4,397,613

[45] Aug. 9, 1983

[54] COMPRESSION WAVE MACHINE

[75] Inventor: Jakob J. Keller, Killwangen, Switzerland

[73] Assignee: BBC Brown, Boveri & Company, Limited, Baden, Switzerland

[21] Appl. No.: 232,622

[22] Filed: Feb. 9, 1981

[30] Foreign Application Priority Data

Mar. 17, 1980 [EP] European Pat. Off. ..... 80200243

[51] Int. Cl.[3] ..... F04F 11/02

[52] U.S. Cl. ..... 417/64

[58] Field of Search ..... 417/64; 60/39.45 A; 123/559; 5/451

[56] References Cited

U.S. PATENT DOCUMENTS

| | | | |
|---|---|---|---|
| 2,952,986 | 9/1960 | Spalding | 417/64 X |
| 3,074,622 | 1/1963 | Berchtold | 417/64 |
| 3,811,796 | 5/1974 | Coleman et al. | 417/64 |
| 4,232,999 | 11/1980 | Croes et al. | 417/64 |

*Primary Examiner*—Edward K. Look

*Attorney, Agent, or Firm*—Burns, Doane, Swecker & Mathis

[57] ABSTRACT

In order to reduce the intermixing of air and exhaust gases in the cells of gas dynamic compression wave machines caused by the formation of shear layer vortices, the geometry of the leading side of the high pressure inlet orifice facing the bucket wheel has a curved convex or convex-polygonal configuration. Also, the ends of cell walls at the gas inlet ends thereof can be of a profiled configuration to further improve the gas flow conditions in the cells.

5 Claims, 2 Drawing Figures

COMPRESSION WAVE MACHINE

BACKGROUND AND OBJECTS OF THE INVENTION

The present invention concerns a gas dynamic compression wave machine of the type comprising a gas dynamic bucket wheel rotating centrally of a pair of lateral flanges at the air and the gas sides. The housing parts are equipped with inlet and outlet orifices, wherein the high pressure gas inlet orifice has a profiled configuration at its opening toward the bucket wheel.

For an understanding of the extremely complex gas dynamic compression wave process, which is not an object of the invention, the Swiss publication CH-T-123063 D is cited. The process sequence necessary for the understanding of the invention is specifically explained in FIG. 2 of the above-cited reference. The bucket belt of individual cells is defined by the unrolling of a cylindrical section of the standard bucket wheel, that moves during the rotation of the latter downward in the direction of the arrow. The shock wave processes take place inside the bucket wheel and effect essentially the formation of a gas-filled and an air-filled space. In the gas-filled space the exhaust gas is depressurized and subsequently escapes through the low pressure gas outlet. In the air-filled space, part of the suctioned-in fresh air is compressed and pushed into the high pressure conduit. The residual part of the fresh air is flushed by the bucket wheel into the low pressure gas outlet and thereby effects a complete exiting of the exhaust gases.

A shock wave machine of the above-described type is known from U.S. Pat. No. 3,074,622, for example, wherein the openings of the outlet conduits are profiled or rounded on the air side and the inlet openings on the lateral part on the gas side have a groove-like, i.e., a concave-polygonal, configuration. It is intended thereby to obtain a gradually increasing compression wave which is to yield a reduced reflection wave upon impact on the opening that is profiled on the air side, especially in the case of extreme mistuning in the lower rotating velocity range of the compression wave machine. Simultaneously, this configuration is expected to yield a reduced outflow at the high pressure inlet opening and a reduced inflow from the high pressure inlet. This is intended to correct the deviations of the wave transit time from the ideal transit time.

The present invention is intended to reduce the mixing of gas and air in the cells, a problem which cannot be solved by the measures disclosed in the above-discussed patents.

SUMMARY OF THE INVENTION

The above-defined object is attained according to the invention in that the leading portion edge of the exhaust gas inlet opening is of convex or convex-polygonal shape to prevent the formation of shear layer vortices.

In the case of a convex-polygonal geometry, it is of particular advantage that two parts of the wall forming the exhaust gas inlet opening abut at an obtuse angle and include identical angles with respect to the horizontal. According to a preferred mode, the width of the wall part inclined toward the bucket wheel amounts to approximately 75% of the distance between two bucket walls.

The newly proposed configuration of the leading edge of the high pressure gas inlet orifice produces a vortex in each cell which, at the rated rotating velocity, is equal to that produced at an upstream wall of the cell but in the opposite direction of rotation. There is no mixing of air and exhaust gas at this rotating velocity. It is of particular advantage that such profiles are of shapes that are readily produced.

According to a further advantageous feature of the invention, the ends of the bucket walls on the gas side have a profiled configuration in order to obtain improved cell flows in cooperation with the profiled opening.

THE DRAWING

In the drawing, examples of the embodiment of the invention are represented in a schematic manner, wherein:

FIG. 1 shows a fragmentary longitudinal sectional view, through the housing of a dynamic bucket wheel according to the invention at half height of the buckets of the bucket wheel, depicting the novel convex opening geometry, and FIG. 2 is a view similar to FIG. 1 of a second embodiment with a convex-polygonal opening geometry.

DETAILED DESCRIPTION OF PREFERRED EMBODIMENTS OF THE INVENTION

Figure 1:
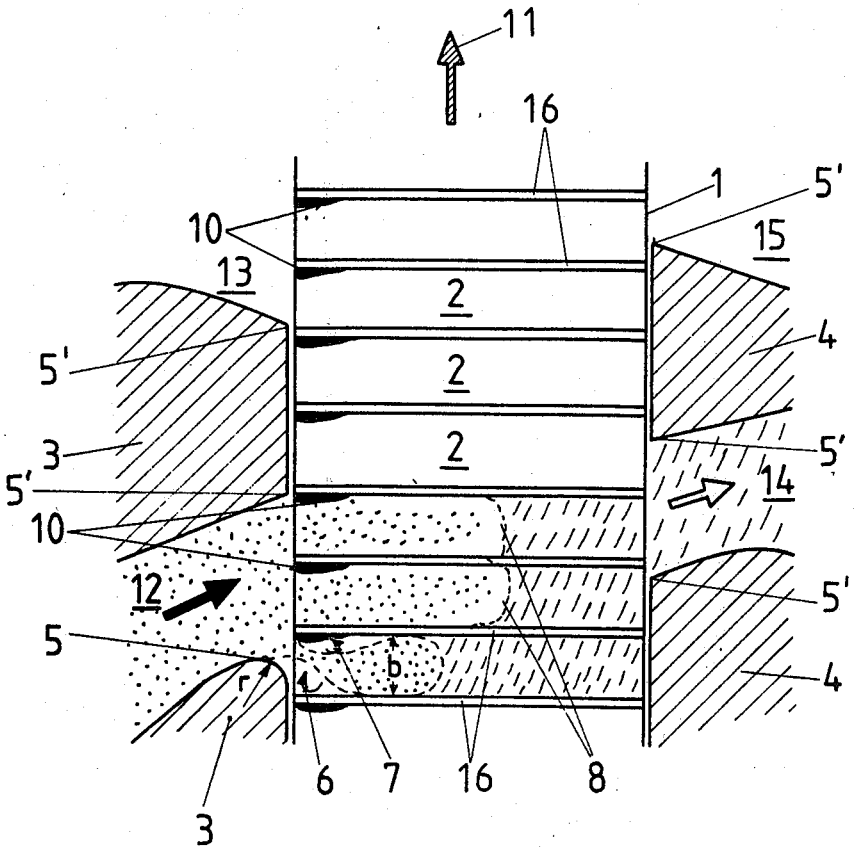

In FIG. 1, a portion 1 of a bucket wheel having individual cells 2, rotates between a lateral housing part 3 on the exhaust gas side and a lateral housing part 4 on the air side, in the direction of the arrow 11. On the frame part 3 a high pressure gas inlet orifice 12 and a low pressure gas outlet orifice 13 are provided, while on the frame part 4 a high pressure air outlet orifice 14 and a low pressure air inlet orifice 15 are provided.

The leading edge 5 of the orifice 12 (i.e., the edge which first "sees" an oncoming bucket cell) facing the bucket 1 of the high pressure gas inlet orifice 12 has a convex configuration, wherein the radius r of the convex curvature amounts to approximately one-half of the distance b between two cell walls 16. Thus, the exhaust gas (represented by the dotted line) which enters a cell 2 at the instant of the opening of the cell enters the cell in a direction dictated by the profiled edge 5. Regardless of the shape of the edge 5, the gas separates as it enters the cell and forms two opposing vortices 6, 7. In the case of a slow cell motion, i.e., at a very low velocity of rotation, in the presence of an unrounded edge (i.e., a prior art configuration), the vortex 6 dominates wherein a flow-off bubble would be formed and would migrate in the counter current direction of the edge 5, as indicated by the arrow 6, to eventually cause the complete break-up or separation of the gas flow. On the other hand, the rounding or profiling of the leading portion of the edge 5 according to the present invention weakens the vortex 6 and renders the two opposing vortices, namely the vortex 6 at the back wall of the cell and a vortex (arrow 7) at the front wall of the cell 2 which to be of more equal strength. There is thus produced a separating front 8 as sharp as possible and perpendicular to the cell walls 16, between the air (indicated by broken lines) and the exhaust gas (indicated by dots).

In order to obtain a nearly ideal cell flow, the ends of the cell walls 16 on the exhaust gas side have a profiled configuration in the form of a curved enlargement 10, whereby a nearly complete suppression of the vortex 6 at the edge of the opening is obtained by means of the effect of the vortex 7 at the front edge generated by the profile 10.

None of the other opening and closing edges 5' on the outlet and inlet openings has a profiled configuration.

Figure 2:
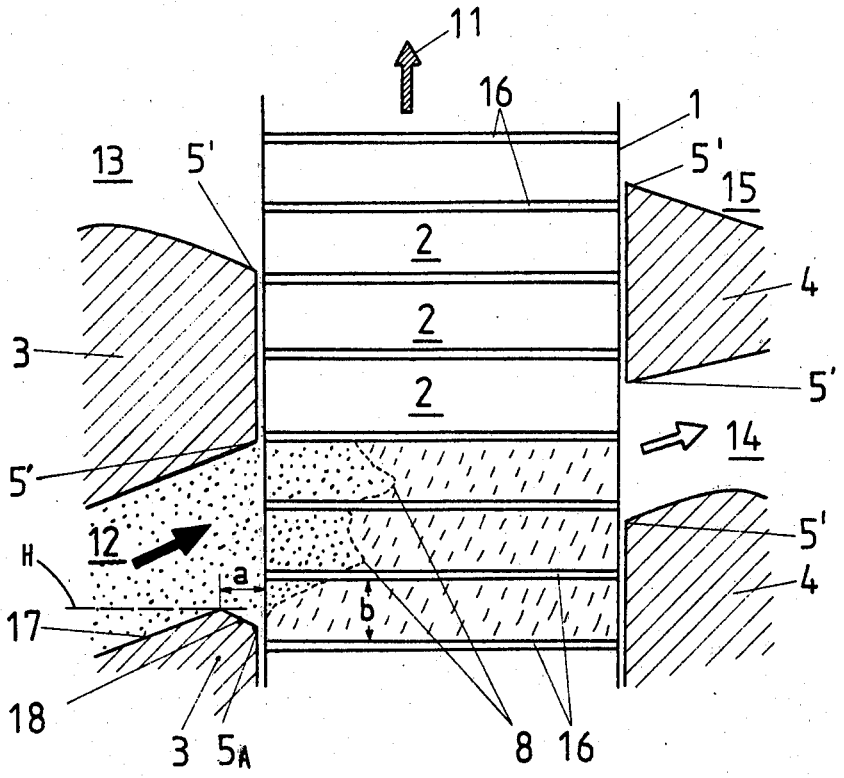

In FIG. 2, identical parts are identified by the same reference symbols as in FIG. 1.

The embodiment shown in FIG. 2 is nearly analogous to the embodiment in FIG. 1, with the exception of the convex-polygonal configuration of the edge 5A of the high pressure gas inlet orifice 12 and the cell walls 16.

The edge 5A is formed by two parts 17, 18 of the wall, abutting at an obtuse angle of for example 160°, in a manner so that both wall parts 17, 18 include the same angle with the horizontal H (i.e., a line parallel to the wheel axis). The wall part 18 is inclined toward the bucket wheel in a direction counter to the direction of rotation 11 and has a width a. The wall parts 17, 18 are preferably arranged so that the width a (in a direction parallel to the wheel axis) of the wall part 18 amounts to approximately 75% of the distance b between two cell walls 16.

An embodiment of this type yields a structurally simple geometry that is insensitive in relation to flow mechanics, wherein an equilibrium between the opening and front edge vortexes is attained without profiled cell walls 16, as indicated by the separating front 8 between the exhaust gas shown by dots and the air represented by shading.

Although the invention has been described in connection with a preferred embodiment thereof, it will be appreciated by those skilled in the art that additions, modifications, substitutions and deletions not specifically described, may be made without departing from the spirit or scope of the invention as defined in the appended claims.

What is claimed is:

1. In a gas dynamic compression wave machine of the type comprising a bucket wheel rotating centrally between lateral housing parts on air and gas sides of the wheel, each housing part including inlet and outlet orifices, wherein a high pressure gas inlet orifice has a profiled configuration at its opening toward the bucket wheel, the improvement wherein the profile is on a leading edge of said orifice and is of convex shape to prevent shear layer vortexes.

2. Apparatus according to claim 1, wherein said profile is of curved convex shape, and has a radius of curvature equal to approximately one-half the distance between the cell walls.

3. Apparatus according to claim 1, wherein said profile is of convex-polygonal shape and is formed by two wall parts defining an angle of approximately 160° therebetween, each of said wall parts forming the same angle with a horizontal plane.

4. Apparatus according to claim 3, wherein one of said wall parts is inclined toward the bucket wheel in a direction counter to wheel rotation, with the width of said one wall part comprising approximately 75% of the distance between the cell walls.

5. Apparatus according to claim 1, wherein the ends of cell walls adjacent the inlet side of the wheel have profiled configurations.

* * * * *